US006352079B1

(12) United States Patent
Bate

(10) Patent No.: US 6,352,079 B1
(45) **Date of Patent: *Mar. 5, 2002**

(54) WIG FOUNDATION WITH CONTOURED FRONT HAIRLINE

(75) Inventor: Laurence Bate, Kansas City, MO (US)

(73) Assignee: Celebrity Signatures International, Inc., Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/389,704

(22) Filed: Sep. 3, 1999

Related U.S. Application Data

(63) Continuation of application No. 09/149,598, filed on Sep. 8, 1998, now Pat. No. 5,988,177.

(51) Int. Cl.[7] ..... A41G 5/00
(52) U.S. Cl. ..... 132/54
(58) Field of Search ..... 132/201, 53, 54, 132/56

(56) References Cited

U.S. PATENT DOCUMENTS

| | | | | | |
|---|---|---|---|---|---|
| 2,814,301 | A | * | 11/1957 | Schmitz | 132/54 |
| 3,307,563 | A | | 3/1967 | Regina | |
| 3,683,941 | A | * | 8/1972 | Friedland | 132/53 |
| 3,734,105 | A | | 5/1973 | Borghese | |
| 3,777,768 | A | | 12/1973 | Scigliano | |
| 3,834,403 | A | | 9/1974 | Ahn | |
| 3,862,638 | A | | 1/1975 | Fannin | |
| 3,889,695 | A | * | 6/1975 | Incando | 132/53 |
| 4,509,539 | A | * | 4/1985 | Alfieri | 132/53 |
| 4,576,189 | A | | 3/1986 | Regina | |
| 4,799,502 | A | * | 1/1989 | Kobayashi et al. | 132/53 |
| 5,271,420 | A | | 12/1993 | Park | |
| 5,406,971 | A | | 4/1995 | Taylor | |
| 5,657,774 | A | * | 8/1997 | Niese | 132/54 |
| 5,746,232 | A | * | 5/1998 | Martin et al. | 132/54 |
| 5,873,373 | A | * | 2/1999 | Narvick | 132/54 |

FOREIGN PATENT DOCUMENTS

DE 3542123 A1 6/1987

* cited by examiner

*Primary Examiner*—Todd E. Manahan
(74) *Attorney, Agent, or Firm*—Armstrong Teasdale LLP

(57) ABSTRACT

A wig includes a foundation fabricated from thin nylon lace. The wig also includes a plurality of wefts of hair. The foundation includes a crown, a top area, a back, a plurality of sides, and a front. The crown and the top area are fabricated from a thin non-stretch nylon lace and the back and sides are fabricated from a thin stretch nylon lace. The front is also fabricated from nylon and has a velvet-like front that closely follows the contour of the wearer's head. The wefts of hair are attached to the foundation in such a manner as to provide a natural appearance. A net material at the crown of the foundation provides support for each weft of hair resulting in a light airy appearance with a natural look.

20 Claims, 1 Drawing Sheet

WIG FOUNDATION WITH CONTOURED FRONT HAIRLINE

This application is a continuation application of U.S. patent application Ser. No. 09/149,598 now U.S. Pat. No. 5,988,177 filed Sep. 8, 1998.

BACKGROUND OF THE INVENTION

This invention relates generally to hair pieces and, more particularly, to foundations to be used with wigs.

A wig foundation is a piece of fabric that fits over the head of a person and is used to affix either human or artificial hair thereto. The foundation can cover either a portion of the head or the foundation can cover the entire head. The foundation fabric should be strong since the hair needs to be attached to the fabric. The hair may be fixed manually in small groups, i.e., by knotting them to the cap. Alternatively, the hair can be formed into strips and then the strips of hair can be fitted to the foundation.

In addition the foundation should have a degree of elasticity to provide a comfortable fit to the wearer. The foundation should conform to the shape of the wearer's head and should fit securely on the wearer's head. A problem with known foundations is that strong foundations may not provide much elasticity and comfort to the wearer, while elastic foundations may not provide the strength and support required to hold the hairs in place.

Accordingly, it would be desirable to provide a foundation for a wig that has the strength to retain the hair in place and that is sufficiently flexible to provide a comfortable fit to the wearer. In addition, the foundation should conform to the contours of the wearer's head.

SUMMARY OF THE INVENTION

These and other objects may be attained by a wig that includes a foundation and a plurality of wefts of hair. The foundation includes a crown, a top area, a back, a plurality of sides, and a front. The crown and the top area are fabricated from a thin non-stretch nylon lace and the back and sides are fabricated from a thin stretch nylon lace. The front includes a contoured hairline and is also fabricated from nylon. The front has a velvet-like appearance that closely follows the contour of the wearer's head.

The wefts of hair are attached to the foundation in such a manner as to provide a natural appearance. A net material at the crown of the foundation provides support for each weft of hair resulting in a light airy appearance with a more natural look.

The foundation closely follows the contours of the wearer's head due, at least in part, to the use of thin materials. The thin materials result in a comfortable, secure fit that is light and stretchable.

DETAILED DESCRIPTION

Figure 1:
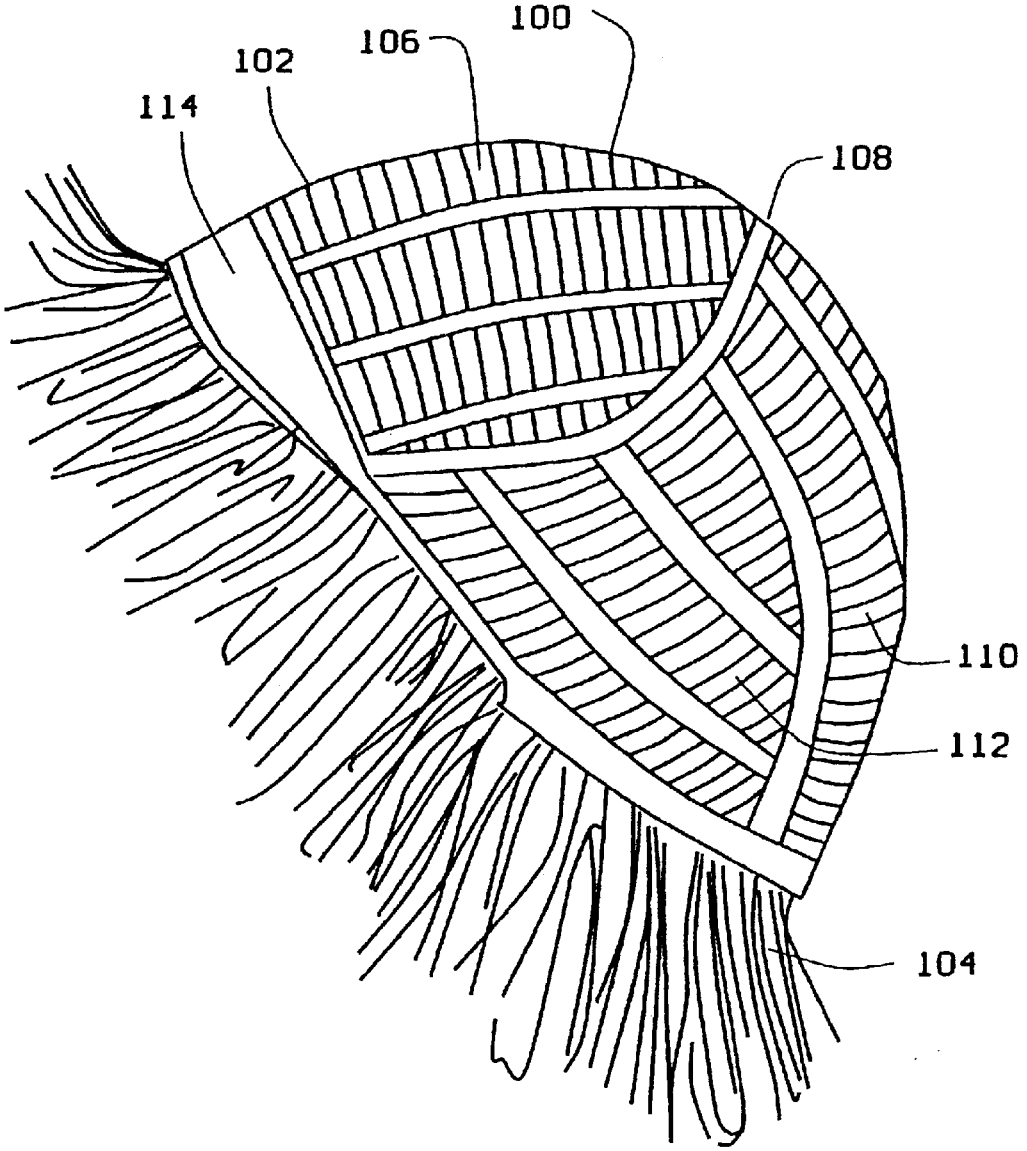
FIG. 1 is a perspective view of a wig and foundation in accordance with one embodiment of the present invention.

FIG. 1 is a perspective view of a wig 100 including a foundation 102 and wefts of hair 104. Foundation 102 includes a crown 106, a top area 108, a back 110, a plurality of sides 112, and a front 114. Crown 106 is fabricated from non-stretch lace that is thin and provides strength to foundation 102 for attaching hair 104. In one embodiment, the lace is fabricated from nylon and is approximately 3/16 of an inch wide. Known lace used for fabricating crowns is usually much thicker and is typically ½ of an inch wide or more. The thinner lace provides a better fit while maintaining the strength and shape retention desirable in wig foundations. A net material is provided at crown 106 to provide support for each weft of hair 104 that is attached to crown 106. The net material results in a light airy appearance for the hair that provides a natural appearance.

Top area 108 also is fabricated from non-stretch lace that is thin and provides strength to foundation 102 for attaching hair 104. In one embodiment, the lace is fabricated from nylon and is approximately 3/16 of an inch wide. Known lace used for fabricating top areas is usually much thicker and is typically ½ of an inch wide or more. The thinner lace provides a better fit while maintaining the strength and shape retention desirable in wig foundations. In addition, the thinner lace is cooler and provides more comfort to the wearer than many known foundations.

Back 110 is fabricated from stretch lace that retains the shape and contours of the wearer's head better than many known foundations. In one embodiment, the stretch lace is fabricated from nylon that includes strands of spandex. The nylon includes 9 strands of spandex, with each strand being approximately 420 denier. Known lace used for the back and sides of wig foundations is usually much thicker and typically does not mold to the wearers head very well. The stretch lace for back 110 retains the shape of the wearer's head, and maintains that shape for an extended period of time.

Sides 112 of foundation 102 are fabricated from stretch lace that is similar to that described above for back 110. The lace is fabricated from nylon that includes 9 strands of spandex. Each spandex strand is approximately 420 denier. The size and amount of spandex in the nylon provides sufficient strength to the foundation to maintain hair 104 and still provides a degree of flexibility that enables the foundation to conform to the contours of the wearer's head. Although only one side 112 is illustrated in FIG. 1, foundation 102 includes two sides 112 that are substantially mirror images of each other. The stretch lace is approximately ¼ of an inch wide. Typical known stretch lace used in known foundation is usually ½ of an inch wide or more. Stretch lace having a smaller width allows more conformity to the wearer's head and provides more shape retention ability.

Front 114 includes a velvet rim fabricated from nylon. The velvet rim is formed into a contoured hairline that provides a comfortable fit and a minimum amount of friction on the scalp. Front 114 is contoured in that the ends are narrower than the middle. This contour allows the hairline to closely follow the contour of the wearer's head.

Foundation 102 closely follows the contours of the wearer's head due, at least in part, to the use of thin materials. In addition, the foundation provides a comfortable, secure fit to the wearer since the material of the foundation is lighter, thinner, and stronger than typically used materials in known foundations.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. For example, the number of spandex strands in the stretch lace could be more or less than 9 and the size could be more or less than 420 denier. In addition, wig 100 could be a hairpiece that covers only a portion of the wearer's head. Accordingly, the spirit and scope of the invention are to be limited only by the terms of the appended claims.

What is claimed is:

1. A foundation for a hair piece comprising:

a crown comprising non-stretch lace;

a top area comprising non-stretch lace, said top area connected to said crown;

a back comprising stretch lace, said back connected to said top area;

a plurality of sides comprising latex stretch lace, each said side connected to said back; and a front connected to said crown.

2. A foundation in accordance with claim 1, wherein said crown non-stretch lace and said top area non-stretch lace are comprised of nylon.

3. A foundation in accordance with claim 1, wherein said back stretch lace is comprised of nylon with strands of spandex.

4. A foundation in accordance with claim 3, wherein said spandex strands are approximately 420 denier, said nylon comprises approximately 9 strands of said spandex.

5. A foundation in accordance with claim 1, wherein said front is contoured.

6. A foundation in accordance with claim 1, wherein said front comprises nylon.

7. A foundation in accordance with claim 1, wherein said back stretch lace is approximately ¼ of an inch wide.

8. A foundation in accordance with claim 1, wherein said crown further comprises net material configured to provide support for a plurality of wefts of hair.

9. A foundation comprising:

a crown;

a top area connected to said crown;

a front comprising a velvet rim, said front connected to said crown;

a plurality of sides comprising latex stretch lace, each said side connected to said crown;

a back comprising stretch lace, said back connected to said sides; and a plurality of wefts of hair.

10. A foundation in accordance with claim 9, wherein said top area and said crown are comprised of non-stretch lace.

11. A foundation in accordance with claim 9, wherein said velvet rim is contoured and includes a first end, a second end, and a middle, said ends narrower than said middle.

12. A foundation in accordance with claim 9, wherein said crown further comprises net material.

13. A wig comprising:

a foundation comprising a crown including lace, a top area including lace, the top area connected to the crown, a back including lace, the back connected to the top area, a plurality of sides comprising nylon stretch lace, each of the sides connected to the back, and a front connected to the crown; and a plurality of wefts of hair attached to said foundation.

14. A wig in accordance with claim 13, wherein said crown and said top area comprise non-stretch lace comprising nylon.

15. A wig in accordance with claim 13, wherein said back comprises stretch lace.

16. A wig in accordance with claim 15, wherein said back stretch lace is comprised of nylon with 9 strands of spandex.

17. A wig in accordance with claim 13, wherein said front comprises nylon.

18. A wig in accordance with claim 13, wherein said front is contoured.

19. A wig in accordance with claim 13, wherein said crown further comprises net material.

20. A foundation in accordance with claim 19, wherein said net material provides support for said plurality of wefts of hair.

* * * * *